US011425478B2

(12) United States Patent
Hart et al.

(10) Patent No.: US 11,425,478 B2
(45) Date of Patent: Aug. 23, 2022

(54) SPEAKER MOUNT AND ASSEMBLY

(71) Applicants: Jonathan Neil Hart, Salt Lake City, UT (US); Margaret A. Goertzen, Sandy, UT (US); Devin Owen Howells, Salt Lake City, UT (US); Christopher Scott Witham, Midvale, UT (US)

(72) Inventors: Jonathan Neil Hart, Salt Lake City, UT (US); Margaret A. Goertzen, Sandy, UT (US); Devin Owen Howells, Salt Lake City, UT (US); Christopher Scott Witham, Midvale, UT (US)

(73) Assignee: SWARM HOLDINGS LLC., Salt Lake City, UT (US)

( * ) Notice: Subject to any disclaimer, the term of this patent is extended or adjusted under 35 U.S.C. 154(b) by 0 days.

(21) Appl. No.: 16/562,401

(22) Filed: Sep. 5, 2019

(65) Prior Publication Data

US 2020/0077168 A1 Mar. 5, 2020

Related U.S. Application Data

(60) Provisional application No. 62/727,382, filed on Sep. 5, 2018.

(51) Int. Cl.
*H04R 1/02* (2006.01)

(52) U.S. Cl.
CPC ..... *H04R 1/026* (2013.01)

(58) Field of Classification Search
CPC .. H04R 1/025; H04R 1/026; H04R 2201/021; A47B 96/061; A47B 96/07; A47B 96/06; F16B 2013/105; F16B 2001/0035; F16B 45/00
See application file for complete search history.

(56) References Cited

U.S. PATENT DOCUMENTS

| | | | |
|---|---|---|---|
| 2,249,231 | A | 7/1941 | Smith |
| 3,250,558 | A | 5/1966 | McClintock |
| 4,439,643 | A | 3/1984 | Schweizer |
| 5,143,339 | A | 9/1992 | Ashcraft et al. |
| 6,101,262 | A | 8/2000 | Haase et al. |
| 6,203,052 | B1 | 3/2001 | Dodge |
| 6,588,543 | B1 | 7/2003 | Tchilinguirian |
| 6,741,720 | B1 | 5/2004 | Myatt |
| 6,925,190 | B2 | 8/2005 | Popken et al. |
| 7,483,544 | B2 | 1/2009 | Wright et al. |
| 7,549,780 | B2 | 6/2009 | Caluori |
| 7,587,059 | B2 | 9/2009 | Wright |

(Continued)

*Primary Examiner* — Angelica M McKinney
(74) *Attorney, Agent, or Firm* — Jason P. Webb; Pearson Butler

(57) ABSTRACT

There is a speaker mount, comprising: a flange; a support member coupled to the flange and having an elevated region spaced therefrom and a closer region closer to the flange than the elevated region, the closer region including a mating structure; and a tab assembly movably coupled to the support member. The tab assembly including: a tab; a coupling member that couples to the mating structure of the support member; and a spacing mechanism coupled to each of the tab and the coupling member that selectably changes an effective spacing between the tab and the coupling member such that the change in effective spacing results in a change in effective distance between the tab and the flange.

8 Claims, 9 Drawing Sheets

(56) References Cited

U.S. PATENT DOCUMENTS

| | | | | |
|---|---|---|---|---|
| 7,731,130 | B2 * | 6/2010 | Decanio | H04R 1/2873 248/27.3 |
| 7,780,135 | B2 | 8/2010 | Nelson et al. | |
| 8,023,664 | B2 | 9/2011 | Yang | |
| 8,162,690 | B2 | 4/2012 | Smith | |
| 8,231,403 | B2 | 7/2012 | Smith | |
| 8,303,336 | B2 | 11/2012 | Smith | |
| 8,485,487 | B2 | 7/2013 | Cheng | |
| 8,526,655 | B2 | 9/2013 | Dibb et al. | |
| 8,605,936 | B2 | 12/2013 | Proni | |
| 8,631,897 | B2 * | 1/2014 | Stewart, Jr. | H04R 1/025 181/150 |
| 8,646,569 | B2 | 2/2014 | Yoshida et al. | |
| 8,672,087 | B2 * | 3/2014 | Stewart, Jr. | H04R 1/025 181/150 |
| 9,366,380 | B2 * | 6/2016 | Humphreys | F16M 13/02 |
| 9,438,974 | B2 * | 9/2016 | Marcum | H04R 1/02 |
| 9,479,852 | B2 * | 10/2016 | Yang | H04R 1/026 |
| 9,729,952 | B2 * | 8/2017 | Ivey | H04R 1/026 |
| 9,913,013 | B1 * | 3/2018 | Santoro | H02G 3/281 |
| 10,024,493 | B2 * | 7/2018 | Hart | F16M 13/027 |
| 10,171,897 | B2 * | 1/2019 | Hart | H04R 1/025 |
| 11,076,211 | B2 * | 7/2021 | Hart | H04R 1/025 |
| 2004/0179710 | A1 * | 9/2004 | Farinelli, Jr. | H04R 1/025 381/386 |
| 2007/0121988 | A1 * | 5/2007 | Merrey | H04R 1/025 381/386 |
| 2009/0324004 | A1 | 12/2009 | Yang | |
| 2010/0040254 | A1 | 2/2010 | Wright | |
| 2011/0017889 | A1 | 1/2011 | Nelson et al. | |
| 2011/0228967 | A1 | 9/2011 | Kulchy et al. | |
| 2012/0049024 | A1 | 3/2012 | Smith | |
| 2014/0305734 | A1 * | 10/2014 | Ivey | H04R 1/025 181/150 |
| 2017/0325588 | A1 * | 11/2017 | Moro | A47B 96/06 |

* cited by examiner

SPEAKER MOUNT AND ASSEMBLY

CROSS-REFERENCE TO RELATED APPLICATIONS

This invention claims priority, under 35 U.S.C. § 120, to the U.S. Provisional Patent Application No. 62/727,382 by Hart et al. filed on 5 Sep. 2018 which is incorporated by reference herein in its entirety.

BACKGROUND OF THE INVENTION

Field of the Invention

The present invention relates to mounts, specifically to mount assemblies and speaker mounts.

Description of the Related Art

In the related art, it has been known to use mounts and assemblies for speakers. Speakers are typically housed in an enclosure which is often a circular, rectangular, or square box made of wood, metal, or sometimes plastic, and the enclosure plays an important role in the quality of the sound. Where high fidelity reproduction of sound is required, multiple loudspeaker transducers are often mounted in the same enclosure, each reproducing a part of the audible frequency range. In this case the individual speakers are referred to as "drivers" and the entire unit is called a loudspeaker. Drivers made for reproducing high audio frequencies are called tweeters, those for middle frequencies are called mid-range drivers, and those for low frequencies are called woofers. Smaller loudspeakers are found in devices such as radios, televisions, portable audio players, computers, and electronic musical instruments. Larger loudspeaker systems are used for music, sound reinforcement in theatres and concerts, and in public address systems.

In the home audio field, there has been an increasing demand for speakers which reproduce high quality sound. In most instances, sound reproduction quality directly correlates with speaker weight which directly correlates with the weight of the magnet contained in the speaker. That is, as speakers use heavier and heavier magnets, the quality of sound reproduction increases. For audiophiles, accurate reproduction of sound is the ultimate goal and therefore, speakers having heavier magnets are often employed. Additionally, the growth of the "home theater" market has lead to a boom in surround sound systems which consist of a number of speakers arranged about a room. Often, it is desired to place at least some of the speakers of such systems off of the floor in order to free up available floor space and avoid unnecessary sound absorption or interference. Accordingly, an increasing number of speakers are being mounted to walls or ceilings in existing homes and structures.

Some improvements have been made in the field. Examples of references related to the present invention are described below in their own words, and the supporting teachings of each reference are incorporated by reference herein:

U.S. Pat. No. 7,587,059, issued to Wright, discloses a baffle assembly fastening system and mounting frame assembly that can be installed and secured without the use of tools. A baffle assembly frame defining an opening to receive a fixture and having an exposed first surface. A fastener is rotationally coupled to the baffle frame. The fastener extends from the exposed first surface to secure the baffle assembly to a recessed mounting frame, wherein the fastener can be manually rotated from a disengaged position to an engaged position [sic] in less ring is coupled to the baffle assembly and has a plurality of aligning posts that serve to align the baffle assembly as it is inserted into a recessed mounting frame.

U.S. Pat. No. 7,549,780, issued to Caluori, discloses a recessed lighting fixture includes a housing having one or more side walls, one or more of which including at least one elongate slot formation, the slot formation including a pair of oppositely extending lateral edge formations, each lateral edge formation having a first dimension, a retaining clip to be located in the slot formation for movement therealong. The retaining clip has a first portion to extend through the slot formation and to travel along an inner surface of the corresponding side wall on opposite sides of the slot formation, a second portion having a second dimension exceeding the first dimension and to travel along an outer surface of a corresponding side wall on opposite sides of the slot formation. The second portion is arranged to be biased outwardly from the housing relative to the first portion, the second portion joined to a third portion, the third portion being arranged to extend through the slot formation in a retained position, in which the third portion is retained against an inner surface of the corresponding lateral edge formation with the second portion in a spring-loaded orientation. The third portion is movable from the retained position to a released position when separated from the lateral edge formation, thereby causing the second portion to be transferred from its spring-loaded orientation to an outwardly extended orientation relative to the housing.

U.S. Pat. No. 5,143,339, issued to Ashcraft et al., discloses a speaker mounting assembly wherein the speaker is supported on a ceiling or wall construction. The baffle associated with the speaker includes a grille face exposed on the exterior of the ceiling or wall and an opposed interior face. Brackets are supported on the interior face, and frame clips are connected to the brackets. These clips include an inwardly extending portion which provides for the attachment of a hairpin spring. A ring is located in spaced relationship with the interior face of the baffle, and openings are defined by the ring for receiving each hairpin spring. In particular, the hairpin spring includes spring arms adapted to engage opposite side edges of the ring openings with the arms being urged apart for thereby urging the baffle toward the ring. The baffle is adapted to be pulled away from the ring in opposition to the action of the spring arms for permitting access to the speaker. The openings for receiving the spring arms preferably define at least two sets of opposed side edges whereby the engagement of the spring arms can be switched between sets of openings to permit adjustment of the forces holding the baffle in position adjacent to the ring.

U.S. Pat. No. 8,485,487, issued to Cheng, discloses an easy-mount in-ceiling speaker mount has multiple fastening units mounted on an in-ceiling speaker. Each fastening unit has a base frame, a torsion spring securely mounted on the base frame, a pivoting member pivotally mounted on the base frame, a slider plate longitudinally movable on the base frame, and a spring holder receiving the torsion spring, pivotally mounted on the base frame and blocked by the pivoting member. When the speaker mount is moved upwardly through a ceiling, a bottom of the ceiling holds a ceiling support formed on the slider plate and the pivoting member is pushed and pivoted. After being unblocked from the pivoting member, the spring holder is pivoted to hold a top of the ceiling in completion of the mounting of the speaker mount. Accordingly, the mounting procedures of the speaker mount can be easily achieved by simply pushing it upwardly through a ceiling.

U.S. Pat. No. 7,731,130, issued to Decanio et al., discloses a spring loaded mounting mechanism for easily mounting and removing a loudspeaker housing within an opening in a surface. The mounting mechanism includes a shaft connected to the loudspeaker housing. Attached to the shaft is a spring actuated arm. The actuated arm is compressed inward toward the housing by the side walls of the surface surrounding the opening when the housing is being positioned within the opening. At a certain point when the housing is inserted far enough into the opening, the actuated arm will lose contact with the side walls of the surface surrounding the opening and will expand to its open position. In its open position, the arm is positioned just behind or against the back face of the surface surrounding the opening, locking the housing into the opening in the surface. The invention further allows for the spring actuated arm to be tightened against or moved away from the back face of the surface by adjusting the positioning of the shaft. To remove the housing from the opening, the spring actuated arm may be moved away from the back face of the surface surrounding the opening by compressing the arm inward toward the housing. The arm may be compressed inward through the use of a device or by the hand of a user. Once the arm is compressed inward, the housing may be easily removed from the opening.

The inventions heretofore known suffer from a number of disadvantages which include being difficult to use, being difficult to install, being unduly complex, being limited in application, being limited in use, being limited in adaptability especially to ranges of wall thickness, being expensive, being expensive/difficult to manufacture, requiring too many parts, needing tools to install, being difficult to remove, being difficult to install/uninstall, being slow to install, having an undesirable and/or non-standard exterior/interior appearance, failing to provide a consistent hold across a range of and/or varying wall thicknesses, failing to grip a sloppy hole well, having too large a profile, taking up too much space (e.g. during storage/transport), having a mechanism that will not work with different tab styles, failing to provide a secure grip, being loose after installation, being difficult to uninstall, leaving air gaps between the flange of the mount and the mounted surface, damaging the mounted surface, requiring special training to properly mount, requiring specialized tooling to properly mount, and/or being too heavy.

What is needed is a speaker mount and/or mount that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available mounts. Accordingly, the present invention has been developed to provide a speaker mount.

According to one embodiment of the invention, there may be a speaker mount that may comprise a flange. A support member may be coupled to the flange and/or having an elevated region spaced therefrom and/or a closer region closer to the flange than the elevated region, the closer region may include a mating structure. The speaker mount may also comprise a tab assembly that may be movably coupled to the support member. The tab assembly may include: a tab; a coupling member that may couple to the mating structure of the support member; and/or a spacing mechanism that may be coupled to each of the tab and/or the coupling member that may selectably change an effective spacing between the tab and/or the coupling member such that the change in effective spacing results in a change in effective distance between the tab and/or the flange.

The mount may further comprise a tab bias member that may be functionally coupled to the tab assembly such that the tab assembly may be biased towards the closer region. The spacing mechanism may include a screw that may be coupled to each of the tab and/or the coupling member. The screw may be in threaded communication with one and/or fixedly coupled to the other.

The spacing mechanism may include a helical ramp that may be rotatably coupled between the tab and/or the coupling member. The spacing mechanism may include an articulating wedge that may be coupled between the tab and/or the coupling member. Each of the coupling member mating structure may include mating teeth.

The coupling member may include a friction pad. The spacing mechanism may change both an effective height of the tab assembly and/or an effective width of the tab assembly. The tab may include a first section coupled to a second section. The second section may have higher elasticity than the first section.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
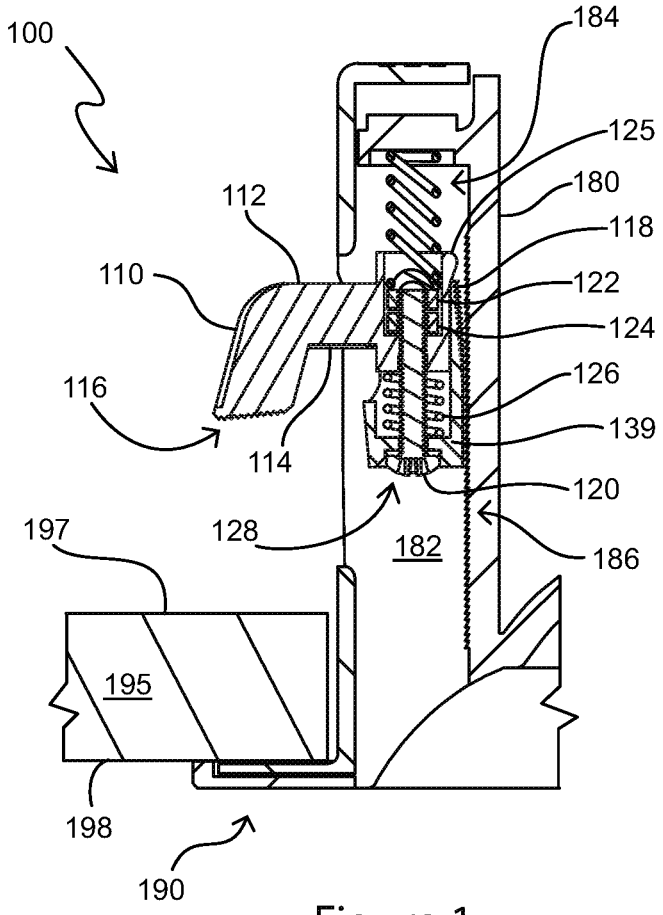
FIG. 1 is a side sectional view of a tab assembly of a mount in a first mode of engaging with a mount surface, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Unless otherwise limited, mounts described herein may serve a variety of purposes, including but not limited to being speaker mounts, video camera mounts, art mounts, light mounts, kiosk mounts, HVAC mounts, and the like and combinations thereof.

Figure 2:
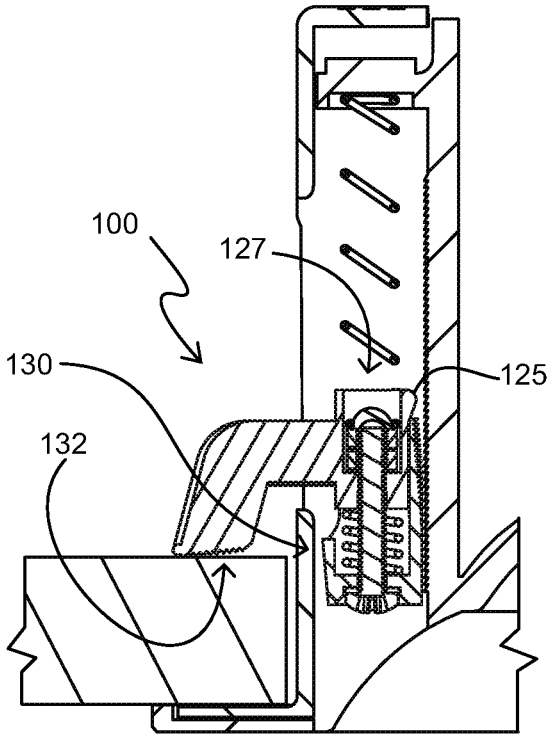
FIG. 2 is a side sectional view of a tab assembly of a mount in a second mode of engaging with a mount surface, according to one embodiment of the invention.
Figure 3:
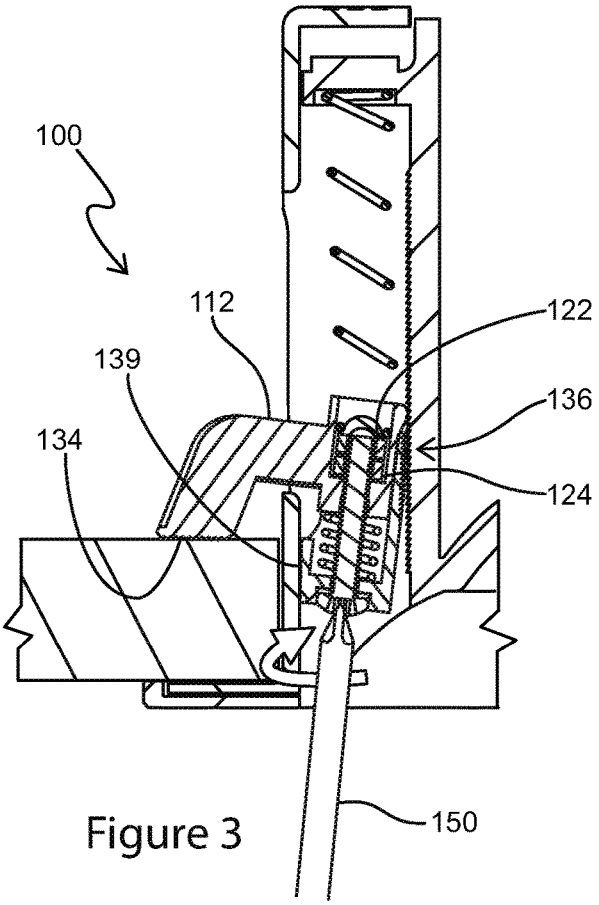
FIG. 3 is a side sectional view of a tab assembly of a mount in transition between a second mode of engaging with a mount surface and a third mode of engaging with a mount surface, according to one embodiment of the invention.
Figure 4:
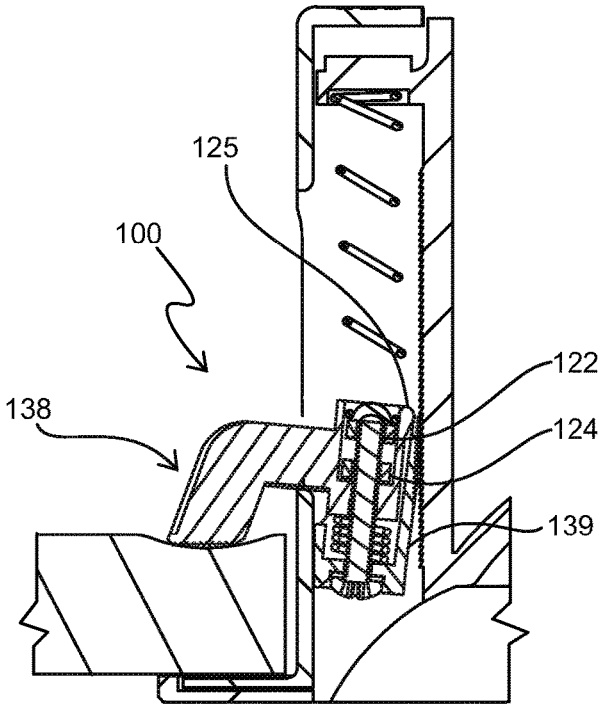
FIG. 4 is a side sectional view of a tab assembly of a mount in a third mode of engaging with a mount surface, according to one embodiment of the invention.
Figure 11:
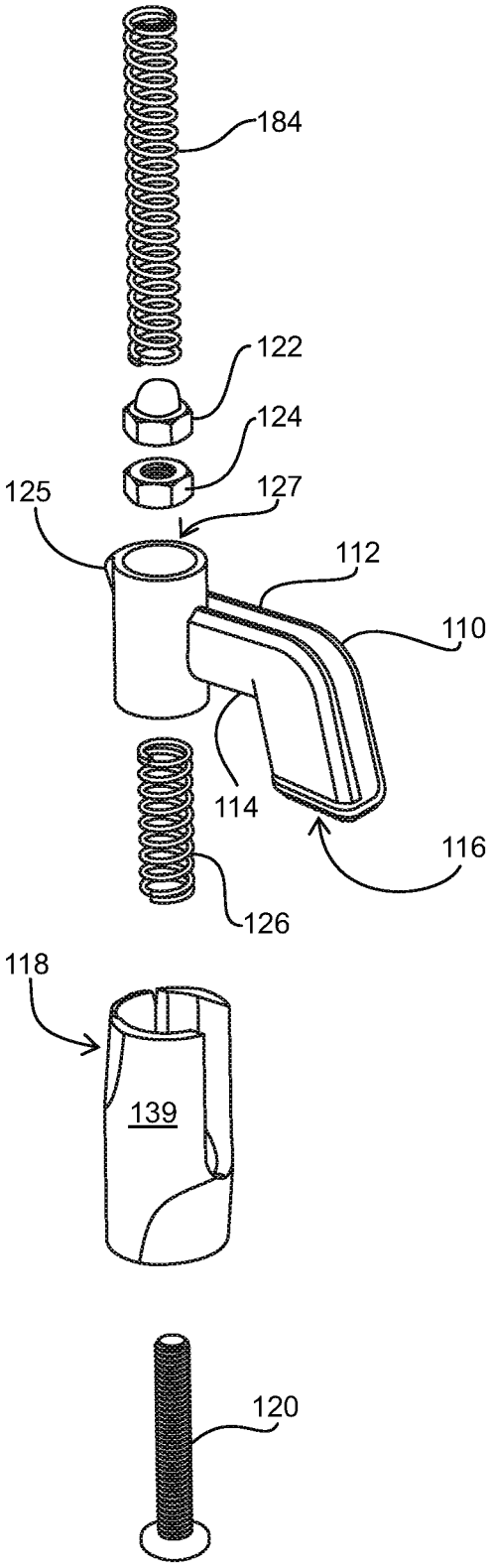
FIG. 11 is an exploded view of a tab assembly of a mount, according to one embodiment of the invention.

FIGS. 1-4 are side sectional views of a tab assembly of a mount, according to one embodiment of the invention. FIG. 1 shows a first mode of engaging with a mount surface wherein the flange of the mount is adjacent to the mount surface (which may trigger a release of the tab assembly by operation of a trigger assembly not shown thereby causing it to spring down against the mount surface), FIG. 2 shows a second mode of engaging with a mount surface wherein the foot of the tab of the tab assembly is pressed against the mount surface; FIG. 3 shows transitioning between a second and third mode of engaging with a mount surface by actuation with a driver, and FIG. 4 shows a third mode of engaging with a mount surface wherein the tab assembly is locked into engagement with the mount surface. Accordingly, the tab assembly may be utilized to conveniently and easily secure a mount to a mount surface and easily lock the mount thereto in a manner that allows for later removal without damage to the mount surface. FIG. 11 is an exploded view of the tab assembly, thereof.

There is shown a tab assembly 100 of a mount that is fixedly coupled to a flange 190 of the mount such that when the flange of the mount engages with a mount surface 195, such as but not limited to a sheet-rock panel in a wall/ceiling where the mount is being mounted (e.g. speaker installation), the tab assembly is disposed near the mount surface and can thereby engage with the mount surface pinning the mount surface between the flange and the tab of the tab assembly, thereby securing the mount to the mount surface. Generally, there will be a plurality of such tab assemblies similarly disposed around a perimeter of the flange so that the mount is secured at multiple spaced points about the perimeter thereof.

The illustrated tab assembly 100 includes a tab 110 having a leg extending horizontally and a foot protruding vertically downward from the leg, a coupling member 118 coupled to the tab 110, and a support member 180 wherein the tab and coupling member are disposed within a support member 180 with the leg and foot of the tab extending out thereof. The illustrated tab 110 has a top surface of tab leg 112, a bottom surface of tab leg 114, and a bottom surface of tab foot 116.

The bottom surface of the tab foot 116 engages with the mounting surface 195. The illustrated bottom surface of the tab foot 116 is angled with respect to the flange and mounting surface such that when the tab assembly is in a second mode (See FIG. 2), the bottom surface of the tab does not rest flat against a top side 197 of the mounting surface 195, as shown by a gap in the pre-engagement interface 132. There is a corresponding path gap 130 between the interior wall 182 of the support member and the coupling member 118 that allows for the tab and coupling member to cant inside the support member (See FIGS. 3 and 4) which allows for the bottom surface of the tab foot to be parallel to the top side of the mount surface and simultaneously allows for the mating teeth to fully engage with each other. When the coupling member 118 cants/tilts inside the support member, the path gap 130 is closed to become a compressed interface 138, which may provide a friction grip between the coupling member and the support member thereby enhancing the locking function of the tab assembly and supporting the engagement of the mating teeth. The illustrated coupling member 118 includes an array of mating teeth disposed behind the tab opposite the tab leg and foot coupled to a drive body 139.

It may be that the tab rotates outward when triggered by the mounting surface such that the tab is out of the way when the mount is inserted into an aperture of the mounting surface but then may be positioned to engage the same, such as the tabs of U.S. Pat. No. 10,024,493, which is incorporated by reference for its supporting teachings.

There is shown a spacing mechanism that is coupled to each of the tab and the coupling member that selectably changes an effective spacing between the tab and the coupling member such that the change in effective spacing results in a change in effective distance between the tab and the flange. The spacing mechanism includes a screw through each of the coupling member and the tab coupled to a pair of nuts. The illustrated screw 120 couples the coupling member 118 to the tab 110 and is disposed therebetween. Coupled to the screw 120 are a top nut 122 (e.g. the illustrated acorn nut) that is fixedly coupled to the end of the screw but rotatable inside the tab cavity and a spacing nut 124 that is threadedly coupled to the screw and not rotatable inside the drive cavity 127 such that as the screw is turned the spacing nut is unable to turn and therefor travels along the screw and changes vertical location with respect to the screw, thereby drawing the tab downward as the spacing nut increases in space in relation to the top nut. An articulating wedge 125 is disposed between the tab 110 and the coupling member 118. The illustrated articulating wedge 125 is fixedly coupled to the tab 110 and protrudes therefrom. There is also a spacing spring 126 that is disposed about the screw 120 which serves to bias the tab and the screw head upward so that such that the head of the screw is biased to remain against the coupling member body which also biases the tab upwards but limited by the length of the screw between the tab and the coupling member. The screw 120 also has a drive 128 engageable by a driver (e.g. the illustrated screwdriver 150). There is a drive body 139 disposed about the drive 128 of the screw 120.

The illustrated support member 180 is a support member coupled to a flange and has an elevated region spaced therefrom and a closer region closer to the flange than the elevated region, the closer region including a mating structure 186. The support member 180 also includes an interior wall of support member 182 which encloses the coupling member 118 and a portion of the tab 110. There is also a drive spring 184 coupled to the support member 182 and the tab 110. The support member 180 also includes a mating structure 186 that mates with the illustrated mating teeth of the coupling member 118.

The illustrated flange 190 is coupled to the support member 180 and may include and/or be near to one or more trigger assemblies (not shown) that allow the tab assembly to be triggered into snapping down against the mount surface when triggered. The illustrated flange 190 is coupled to mounting surface 195. The mounting surface 195 includes a top panel surface 197 and a bottom panel surface 198, wherein the flange 190 is pressed against the bottom panel surface 198.

The illustrated tab assembly 100 includes a tab 110. The tab 110 has a top surface of tab leg 112, a bottom surface of tab leg 114, and a bottom surface of tab foot 116. The tab 110 is substantially J-shaped so that the top surface of tab leg 112 and the bottom surface of tab leg 114 extend the tab 110 substantially away from an interior wall of support member 182, and so that the bottom surface of tab foot 116 extends substantially downward toward a mounting surface 195. The bottom surface of tab foot 116 may be serrated, toothed, textured, etc. for gripping the sheet rock panel. The tab 110 extends from the coupling member 118, thereby enabling the tab 110 to grip a top panel surface of the mounting surface 195. The tab 110 is disposed opposite a flange 190 so that the tab 110 and the flange 190 couple the speaker mount to the mounting surface 195. For example, in one non-limiting embodiment, the tab 110 and the flange 190 couple the speaker mount to a sheet rock panel by tension-fit. Accordingly, the tab 110 may have any size and/or shape for mounting to a sheet rock panel. Likewise, the tab 110 may be comprised of a variety of materials for mounting, such as, but not limited to: wood, metal, plastic, rubber, composite, PVC, etc. and any combination thereof.

The illustrated screw 120 couples the coupling member 118 to the tab 110 and is disposed therebetween. Coupled to the screw 120 are a top nut 122 and a spacing nut 124 (the nuts 122 and 124 are disposed within a tab cavity 127), and a drive spring 184 is disposed about the top nut 122 inside the tab cavity 127 and extends upward away from the tab towards a top of the support member, where it is braced to provide a downward bias against the tab.

The screw also has a drive 128, such as, but not limited to, a slit, for example, and the coupling member 118 includes a drive body 139 disposed about the drive 128 of the screw. Accordingly, the screw 120 may be twisted or turned to travel along the spacing spring 126, and in order to adjust a distance between the top nut 122 and the spacing nut 124, and so that the tab 110 may travel up and down within the support member 180 with respect to the coupling member.

The illustrated articulating wedge 125 is disposed between the tab 110 and the coupling member 118. The articulating wedge 125 causes the body of the coupling member 118 to expand/contract as a distance between the top nut 122 and the spacing nut 124 is adjusted, since the articulating wedge is larger than the spacing into which it enters between the tab and the coupling member as the illustrated coupling member further "swallows" the tab. This causes the body of the coupling member to bulge outward which further increases the strength of engagement of the mating structure. The coupling member 118, the screw 120, the spacing spring 126, the articulating wedge 125, the top nut 122 and the spacing nut 124 may be comprised of a variety of materials for moving, adjusting, tilting the tab 110, such as, but not limited to: wood, metal, plastic, rubber, composite, PVC, etc. and any combination thereof.

In one, non-limiting embodiment, the tab assembly 100 is movably coupled to the support member 180. For instance, the tab assembly 100 may be rotatably or slidably coupled to the support member 180. A flange 190 is also coupled to the support member 180 and extends substantially outwardly therefrom opposite the tab 110 of the tab assembly 100. In one, non-limiting embodiment of the invention, the support member 180 may have an elevated region spaced from the flange 190 and a closer region to the flange 190 that the elevated region so that the closer region includes the mating structure 186. As shown, the mating structure 186 may be serrated for mating. However, the mating structure may have any size and/or shape for mating, such as, but not limited to: serration, teeth, texture, knobs, threading and so on. The mating structure 186 may be integral to, or separate from the support member 180. As a result, the mating structure 186 may be comprised of a variety of materials, such as, but not limited to: wood, metal, plastic, rubber, composite, PVC, etc. and any combination thereof.

As illustrated, the flange 190 couples to the mounting surface 195 along a bottom panel surface 198 opposite the tab 110. As a result, the flange 190 may have any size and/or shape for mounting to the mounting surface 195. Likewise, the flange 190 may be comprised of a variety of materials for mounting, such as, but not limited to: wood, metal, plastic, rubber, composite, PVC, etc. and any combination thereof.

In operation of one embodiment of the invention, the speaker mount may be coupled to a mounting surface 195. A flange 190 may be pressed against a bottom panel surface 198. The tab assembly then transitions between a first mode (retracted) to a second mode (deployed). This may be triggered and/or actuated. Then, secondary internal hardware, such as a spacing mechanism, which may include one or more of a coupling member 118 with a spacing spring 126 and a screw 120, changes an effective spacing between a tab 110 and the coupling member 118, and thereby changes an effective distance between the tab 110 and the flange 190 (e.g. the "swallowing" of FIGS. 3 and 4). Accordingly, the tab 110 and the coupling member 118 may be spaced closer together by turning the screw 120 one direction, and the tab 110 and the coupling member 118 may be spaced further apart by turning the screw 120 another direction. An articulating wedge 125 may slide between the top nut 122 and the coupling member 118 and thereby adjust a shape of the coupling member 118. This may cause the tab and coupling member to pivot within an interior of the support member which may engage 136 the mating teeth. While engaging, the change in spacing between the tab and coupling member and/or the bulging effect of an articulating wedge may apply force to the mating teeth and engage them strongly to each other. As a result, the tab 110 may lock to a top panel surface 197 of the mounting surface 195 opposite the flange 190 to provide a mount for a speaker.

The illustrated depression of the top of the mounting surface in FIG. 4 is exaggerated for illustration purposes.

Advantageously, the primary forces applied by turning the illustrated screw are directly applied to the coupling member and support member at the mating teeth and the compressed interface. Further, the forces so applied are limited by the strength of the springs and the shape/size of the articulating wedge. Therefore, maximum forces may be engineered into the apparatus by selecting wedge shapes/sizes and spring strengths and those maximum forces cannot be breached by an installer who overzealously turns the screw. Further, the forces actually applied to the mounting surface by the tab foot will be less than those applied to the mating teeth/etc. and therefore the locking effect can be extremely strong, while being very gentle on the mounting surface. This is particularly important with comparatively fragile mounting surfaces such as sheet rock, where the force that one could apply to a strong plastic mount having significant elasticity without damaging the mount is far greater than what one could apply to sheet rock without damaging the same. Accordingly, one may successfully create a firm and solid lock to a fragile mounting surface that is very forgiving of over-rotation of the screw by a poorly trained installation tech.

Figure 5:
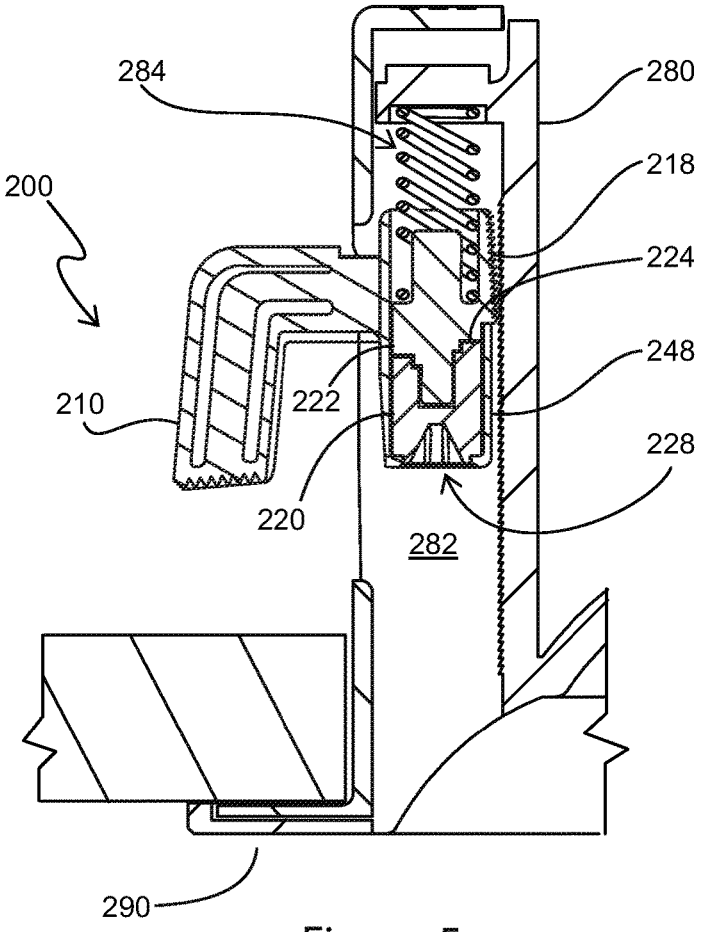
FIG. 5 is a side sectional view of a tab assembly of a mount in a first mode of engaging with a mount surface, according to one embodiment of the invention.
Figure 6:
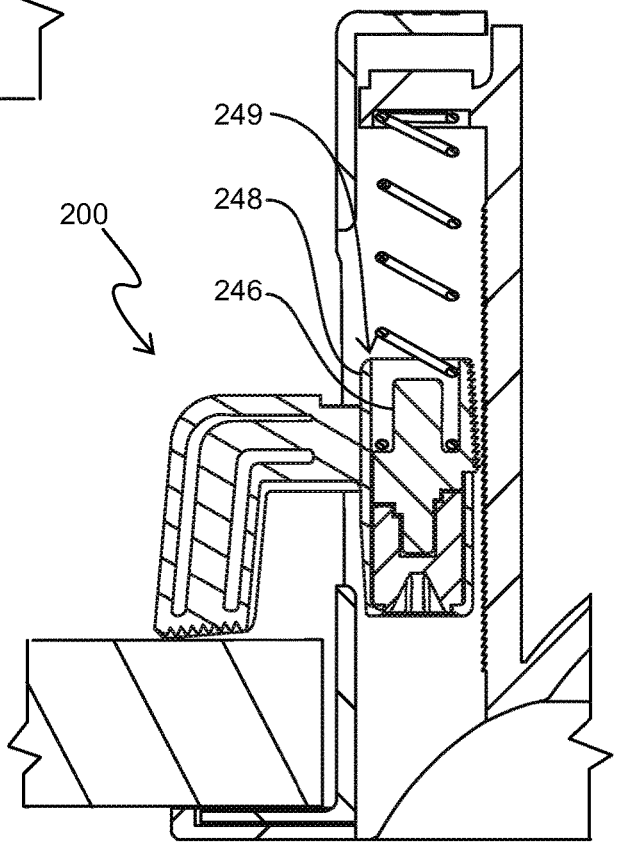
FIG. 6 is a side sectional view of a tab assembly of a mount in a second mode of engaging with a mount surface, according to one embodiment of the invention.
Figure 7:
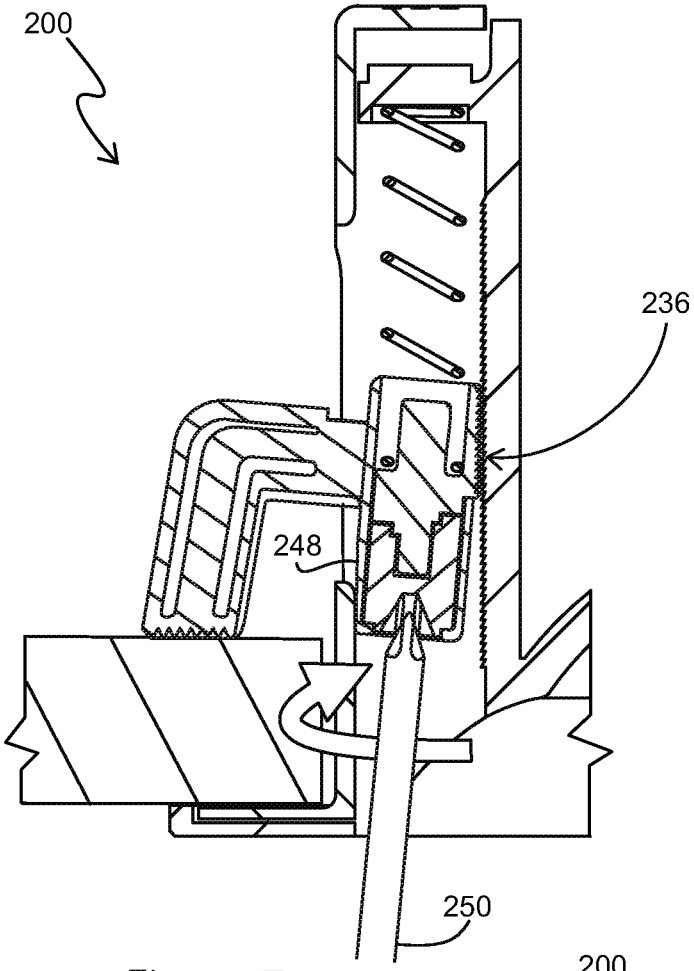
FIG. 7 is a side sectional view of a tab assembly of a mount in transition between a second mode of engaging with a mount surface and a third mode of engaging with a mount surface, according to one embodiment of the invention.
Figure 8:
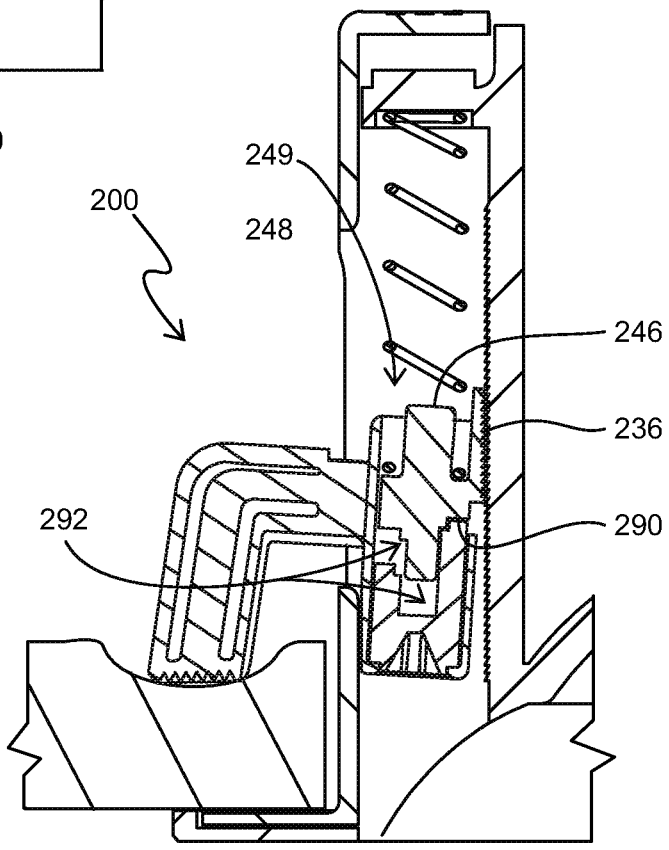
FIG. 8 is a side sectional view of a tab assembly of a mount in a third mode of engaging with a mount surface, according to one embodiment of the invention.
Figure 12:
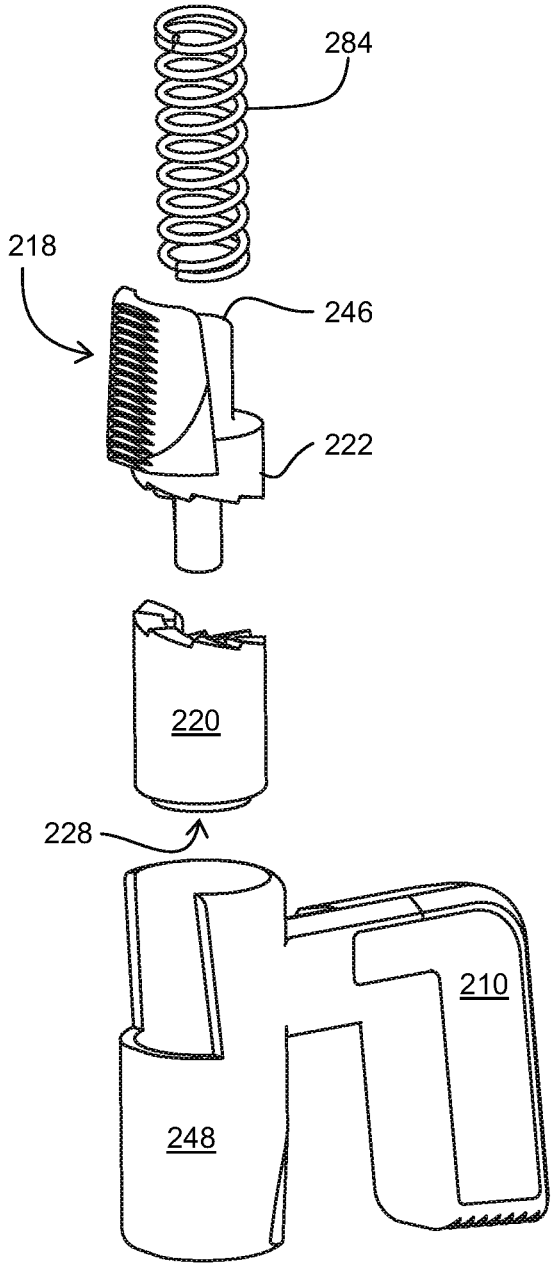
FIG. 12 is an exploded view of a tab assembly of a mount, according to one embodiment of the invention.

FIGS. 5-8 are side sectional views of a tab assembly of a mount utilizing a helical ramp between the coupling member and the tab, according to one embodiment of the invention. FIG. 5 shows a first mode of engaging with a mount surface wherein the flange of the mount is adjacent to the mount surface (which may trigger a release of the tab assembly by operation of a trigger assembly not shown thereby causing it to spring down against the mount surface); FIG. 6 shows a second mode of engaging with a mount surface wherein the foot of the tab of the tab assembly is pressed against the mount surface; FIG. 7 shows transitioning between a second and third mode of engaging with a mount surface by actuation with a driver, and FIG. 8 shows a third mode of engaging with a mount surface wherein the tab assembly is locked into engagement with the mount surface. Accordingly, the tab assembly may be utilized to conveniently and easily secure a mount to a mount surface and easily lock the mount thereto in a manner that allows for later removal without damage to the mount surface. FIG. 12 is an exploded view of the tab assembly, thereof.

The illustrated support member 280 is coupled to a flange and has an elevated region spaced therefrom and a closer region closer to the flange than the elevated region, the closer region including a mating structure 236.

There is shown a tab assembly 200 coupled to a mount (shown partially) near a flange 290 of the mount. The tab assembly 200 includes a tab 210 and a coupling member 218 disposed substantially within a tab body 248. The tab 210 and coupling member 218 are coupled together via a spacing mechanism coupled to each of the tab and the coupling member that selectably changes an effective spacing between the tab and the coupling member such that the change in effective spacing results in a change in effective distance between the tab and the flange. The illustrated spacing mechanism includes a first helical ramp body 220, and a second helical ramp body 222, with a helical ramp interface in a closed mode 224 (See FIGS. 5-7) and in an open mode 290 having open ramp gaps 292 (See FIG. 8). There is also shown a drive 228 for the helical ramps 220 and 222, respectively. The illustrated drive 228 allows one to use a driver (e.g. the illustrated screwdriver 250) to rotate the helical ramps with respect to each other, so that they can transition between open and closed modes.

Further shown, the tab assembly 200 is coupled to a support member 280. The support member 280 includes an interior wall of support member 282 with a drive spring 284 for coupling to the tab assembly 200 disposed substantially within. Coupled to the support member 280 is a flange 290.

The illustrated tab assembly 200 includes a tab 210 coupled to a coupling member 218. The tab 210 is J-shaped so that the tab 210 extends substantially away from the coupling member 218, so that the tab 210 extends downward. The illustrated coupling member 218 is disposed within the tab body 248 and is free to translate thereinside. Accordingly, the tab body 248 may have any size and/or shape for substantially housing the coupling member 218. The coupling member 218 couples the tab 210 to a support member 280, and the tab assembly 200 is disposed substantially within an interior wall of support member 282.

The illustrated tab assembly 200 also includes a first helical ramp body 220 and a second helical ramp body 222. The first helical ramp is disposed within the tab body 248. The second helical ramp is disposed against the first helical ramp and is friction fitted to the tab body, but able to slide vertically in relation thereto. The second helical ramp is slotted into the tab body and therefore unable to rotate with respect to the first helical ramp. Accordingly, as the first helical ramp rotates when driven by the drive, the second helical ramp does not rotate and the two helical ramps then may change in relative distance to each other.

There is illustrated a helical ramp interface in closed mode 224. The helical ramp bodies 220 and 222 may be substantially helix- or spiral-shaped for rotating. The illustrated helical ramp bodies 220 and 222 are ramped step-wise such that as the coupling member is rotated with the drive, the installer can feel/hear clicking as the step-wise ramps shift in relative position. This allows for multiple stages of open spacing to be achieved and it also allows for a reversion to a closed mode when the installer rotates the coupling member beyond the final open stage. This guarantees that the change in effective spacing between the coupling member and the tab does not go beyond a predefined range. Further, of note, while FIGS. 1-4 illustrate a spacing mechanism that creates a "swallowing" motion of the tab into the coupling member which results in a locking effect, FIGS. 5-8 illustrate a spacing mechanism that instead "disgorges" the coupling member from the tab which results in a locking effect. The helical ramp bodies 220 and 22 may be comprised of any substantially rigid material that allows for rotating between various modes, such as, but not limited to: wood, metal, plastic, rubber, composite, PVC, etc. and any combination thereof.

The illustrated tab assembly 200 includes a coupling member 218. The coupling member 218 has mated teeth 236. As shown, the mated teeth 236 are serrated; however, the mated teeth 236 may have any size and/or shape for providing grip to the coupling member 218. For instance, the mated teeth 236 may be serrated, toothed, textured, knobbed, and so on. The mated teeth 236 may be configured to mate with protrusions of the interior wall of support member (See e.g., FIG. 5, Item 282). Accordingly, the mated teeth 236 may be comprised of a variety of materials, such as, but not limited to: wood, metal, plastic, rubber, composite, PVC, etc. and any combination thereof.

As illustrated, a drive 228 is coupled to the first helical ramp body 220 of the tab assembly 200. As a result, the drive 228 may drive, turn, twist, move, etc. the helical ramp body 220 relative to ramp body 222 of the coupling member, and thereby change an effective size/shape of the tab assembly 200.

The illustrated tab assembly 200 is biased downwards by a drive spring 284. The drive spring is disposed substantially within an interior wall of support member 282. There is a post 246 disposed substantially within the post cavity 249 about which the drive spring mates in so that the drive spring engages with the tab in a uniform and predictable manner.

Coupled to the support member 280 substantially below the tab assembly 200 is a flange 290. The flange 290 extends substantially outward from the support member 280. As a result, the flange 290 may provide support and/or stabilization. Accordingly, the support member 280 and the flange 290 may be comprised of a variety of materials, such as, but not limited to: wood, metal, plastic, rubber, composite, PVC, etc. and any combination thereof.

The illustrated depression of the top of the mounting surface in FIG. 8 is exaggerated for illustration purposes.

Figure 9:
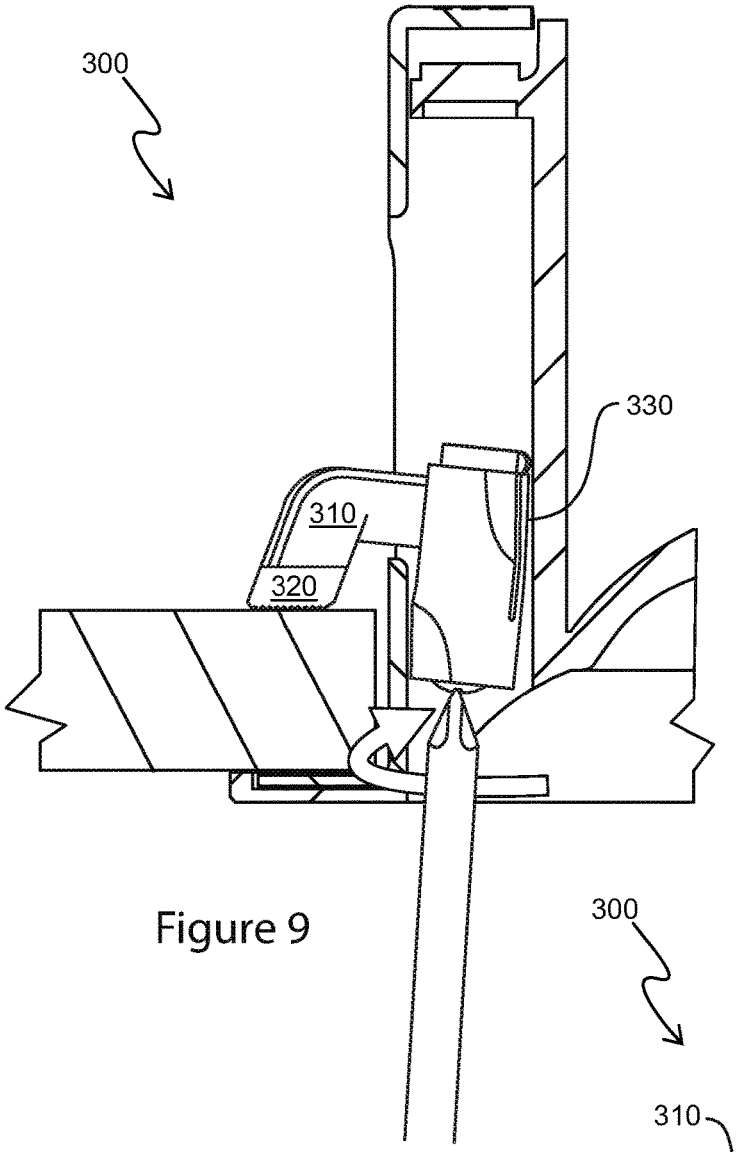
FIG. 9 is a side partial-sectional view of a tab assembly of a mount in a second mode of engaging with a mount surface, the tab of the tab assembly having an elastically deformable foot, according to one embodiment of the invention.

FIG. 9 is a side partial-sectional view of a tab assembly of a mount in a second mode of engaging with a mount surface, the tab of the tab assembly having an elastically deformable foot, according to one embodiment of the invention. There is shown a tab assembly 300. The tab assembly 300 includes a first section 310 and a second section 320 that is elastically deformable. There is also a friction pad 330 disposed at a backside of the tab assembly that engages with the interior of the support member as a friction fit when the spacing mechanism presses the friction pad against the interior of the support member.

The illustrated tab assembly 300 includes a first section 310 and a second section 320. The first section 310 may be constructed separately from the second section 320, or the second section 320 may be a continuation of the first section 310. Hence, the second section 320 may be added, or coupled to, the first section 310. As a result the first and second sections 310 and 320 may be comprised of the same or different materials, such as, but not limited to: wood, metal, plastic, rubber, composite, PVC, etc. and any combination thereof. In one, non-limiting embodiment, the second section 320 may include teeth. Thus, the second section 320 may provide additional grip, pressure, tension, etc. for the tab assembly 300. More, the first section 310 and second section 320 may have any size and/or shape for providing grip. Accordingly, in one, non-limiting embodiment, the second section 320 may have a higher elasticity than the first section 310.

As illustrated, the tab assembly 300 also includes a friction pad 330. The friction pad 330 may be configured to provide friction for the tab assembly 300. For instance, the friction pad may be comprised of a material or substance to create a relatively large coefficient of friction, such as, but not limited to: rubber, leather, Plexiglas, etc. Similarly, the friction pad 330 may be integral to the tab assembly 300 or may constructed separately from the tab assembly 300. Further, the friction pad 330 may have any size and/or shape for creating a suitable surface area for friction.

Figure 10:
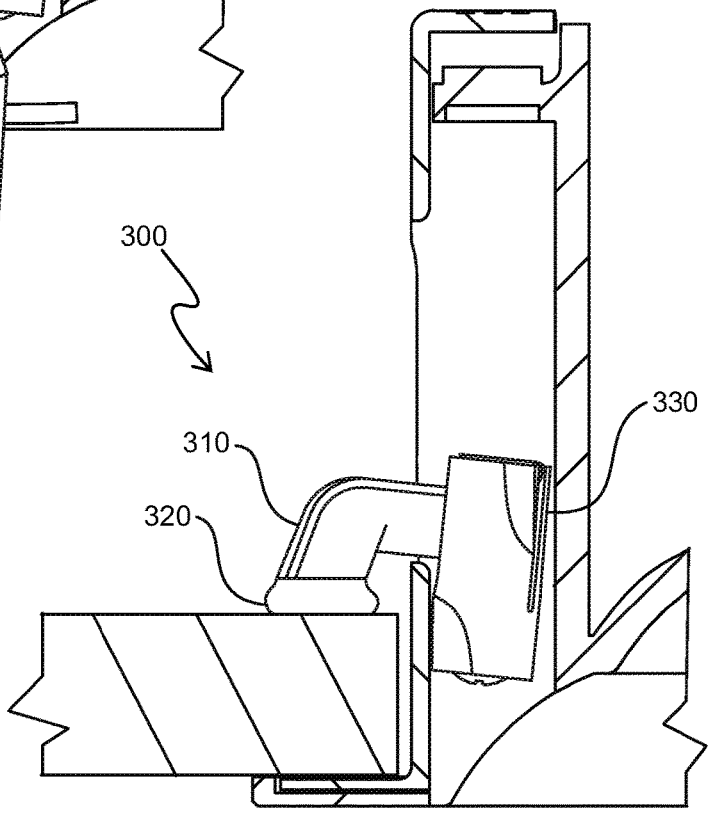
FIG. 10 is a side partial-sectional view of a tab assembly of a mount in a third mode of engaging with a mount surface, the tab of the tab assembly having an elastically deformable foot, according to one embodiment of the invention.

FIG. 10 is a side partial-sectional view of a tab assembly of a mount in a third mode of engaging with a mount surface, the tab of the tab assembly having an elastically deformable foot, according to one embodiment of the invention. There is shown a tab assembly 300. The tab assembly 300 includes a first section 310 and a second section 320. The tab assembly 300 also includes a friction pad 330.

The illustrated tab assembly 300 includes a first section 310 and a second section 320 coupled to the first section 310.

The illustrated second section 320 may be configured to provide additional support, grip, pressure, tension, etc. for the tab assembly 300. The second section 320 may allow the tab assembly 300 to grip a surface without causing damage to said surface. As a result, the second section 320 may be comprised of a variety of materials for gripping a surface, such as, but not limited to: wood, metal, plastic, rubber, composite, PVC, etc. and any combination thereof. Likewise, the second section 320 may have any size and/or shape for providing grip. In one, non-limiting embodiment, the second section 320 may be such as a rubber stopper. In another non-limiting embodiment, the second section 320 has higher elasticity than the first section 310.

FIG. 11 is an exploded view of a tab assembly of a mount (See FIGS. 1-4), according to one embodiment of the invention. There is shown a tab 110 with a top surface of tab leg 112, a bottom surface of tab leg 114, and bottom surface of tab foot 116. The tab 110 also includes an articulating wedge 125 coupled to the tab 110, and a tab cavity 127. Disposed within the tab cavity 127 is a top nut 122, a spacing nut 124, and a spacing spring 126. The tab 110 is disposed within a drive body 139 of a coupling member 118. A drive spring 184 couples to the top nut 122 and to the screw 120.

The illustrated tab 110 includes a top surface of tab leg 112, a bottom surface of tab leg 114, and bottom surface of tab foot 116. The tab 110 is substantially J-shaped so that the top surface of tab leg 112 and the bottom surface of tab leg 114 extend the tab 110 substantially away from a tab cavity 127, and so that the bottom surface of tab foot 116 extends substantially downward. However, the tab 110 may have any size and/or shape for extending and/or gripping. The bottom surface of tab foot 116 may be serrated, toothed, textured, padded, etc. Accordingly, the tab 110 may be comprised of a variety of materials, such as, but not limited to: wood, metal, plastic, rubber, composite, PVC, etc. and any combination thereof.

As illustrated, the tab 110 also includes an articulating wedge 125. The articulating wedge 125 is coupled to the tab 110 and extends outwardly therefrom. The articulating wedge couples to the coupling member 118, and enables the tab 110 and coupling member to tilt, or rotate, as a distance between the top nut 122 and the spacing nut 124 is adjusted. The articulating wedge 125 is substantially teardrop shaped; however, the articulating wedge 125 may have any size and/or shape for forming a joint and/or wedging the tab 110. Accordingly, the articulating wedge 125 may be comprised of a variety of materials, such as, but not limited to: wood, metal, plastic, rubber, composite, PVC, etc. and any combination thereof.

The illustrated top nut 122 and spacing nut 124 may be disposed substantially within the tab cavity 127. The top nut 122 couples to the drive spring 184 and the spacing nut 124 couples to the spacing spring 126. The screw 120 couples to both the top nut 122 and the spacing nut 124. As a result, a distance between the top nut 122 and the spacing nut 124 may be adjusted by turning the screw 120. For example, in one non-limiting embodiment, the screw 120 is turned a first direction and the spring 126 compresses, thereby allowing the spacing nut 124 to travel away from the top nut 122. In another non-limiting embodiment, the screw 120 is turned a second direction, opposite the first direction, and the spring 126 extends, thereby allowing the spacing nut 124 to travel toward the top nut 122. Accordingly, the springs 126 and 184 may have any size and/or shape for compressing and extending. More, the springs 126 and 184 may be comprised of a variety of materials for compressing and extending, such as, but not limited to: metal, plastic, rubber, etc. and combinations thereof. Likewise, the screw 120 may have any size and/or shape for connecting the top nut 122 and the spacing nut 124, and may be comprised of a variety of materials for connecting, such as, but not limited to: wood, metal, plastic, rubber, composite, PVC, etc. and any combination thereof.

As illustrated, the tab 110 couples to the coupling member 118. The coupling member includes a drive body 139. In one, non-limiting embodiment, the tab 110 may couple to the coupling member 118 by insertion or sliding. Accordingly, the coupling member 118 may substantially house, contain, and/or support the tab 110, the screw 120, the top nut 122, the spacing nut 124, the articulating wedge 125, the spacing spring 126, and the drive spring 184. As a result, the coupling member 118 with drive body 139 may be sized and/or shaped to house, contain and/or support. Similarly, the coupling member 118 may be comprised of a variety of materials to house, contain, and/or support, such as, but not limited to: wood, metal, plastic, rubber, composite, PVC, etc. and any combination thereof.

FIG. 12 is an exploded view of a tab assembly of a mount (See FIGS. 5-8), according to one embodiment of the invention. There is shown a tab 210 with a tab body 248. A first helical ramp body 220 with a drive 228 couples to the tab body 248. A second helical ramp body 222 with a coupling member 218 and a post 246 couples to the first helical ramp body 220. A drive spring 284 couples to the tab 210.

The illustrated tab 210 includes a tab body 248. The first helical ramp body 220 is disposed substantially within the tab body 248 of the tab 210 while the second helical ramp is slotted into the tab body such that it cannot rotate with respect to the first helical ramp, but it is slideably coupled to the slot of the tab body. As a result, the tab body 248 may be sized and/or shaped to house, contain, and/or support the helical ramp bodies 220 and 222. Likewise, the tab body may be comprised of a variety of materials to house, contain, and/or support, such as, but not limited to: wood, metal, plastic, rubber, composite, PVC, etc. and any combination thereof.

As illustrated, the first helical ramp body 220 couples to the tab body 248. The first helical ramp body 220 may be substantially helix- or spiral-shaped; however, the first helical ramp body 220 may have any size and/or shape for rotating. In addition, the first helical ramp body 220 may be comprised of a variety of materials, such as, but not limited to: wood, metal, plastic, rubber, composite, PVC, etc. and any combination thereof.

The illustrated first helical ramp body 220 couples to the second helical ramp body 222. Accordingly, in one, non-limiting embodiment, the first helical ramp body 220 and the second helical ramp body 222 may include surfaces for mating. Like the first helical ramp body 220, the second helical ramp body 222 may be substantially helix- or spiral-shaped; however, the second helical ramp body 222 may have any size and/or shape for rotating. In addition, the second helical ramp body 222 may be comprised of a variety of materials, such as, but not limited to: wood, metal, plastic, rubber, composite, PVC, etc. and any combination thereof.

As illustrated, the first helical ramp body 220 also includes a drive 228. The drive 228 is coupled to the first helical ramp body 220. In one non-limiting embodiment, turning or twisting the drive 228 turns the first helical ramp body 220, and thereby causes the second helical ramp body 222 to translate slideably. Accordingly, the drive 228 may have any size and/or shape for driving the helical ramp bodies 220 and 222. Likewise, the drive 228 may be comprised of a variety of materials for driving, such as, but not limited to: wood, metal, plastic, rubber, composite, PVC, etc. and any combination thereof.

The illustrated second helical ramp body 222 includes a post 246. The post 246 is coupled to the second helical ramp body 222 and extends therefrom. The post 246 couples to the drive spring 284. As a result, the post 246 may provide support for the drive spring 284. As a result, the post 246 may have any size and/or shape for providing support. Further, the post 246 may be comprised of a variety of materials, such as, but not limited to: wood, metal, plastic, rubber, composite, PVC, etc. and any combination thereof.

As illustrated, the drive spring 284 couples to the post 246 of the second helical ramp body 222. The drive spring 284 is configured to drive the coupling member 218 till it couples with mating structure 236. For example, in one-non-limiting embodiment, the drive 228 is turned a first direction and the drive spring 284 has driven the coupling member 218 to lock with the mating structure 236, thereby allowing the second helical ramp body 222 to travel away from the first helical ramp body 220 and causing the tab 210 to translate further from coupling member 218. In another non-limiting embodiment, the drive 228 is turned a second direction, opposite the first direction, thereby allowing the second helical ramp body 222 to travel toward the first helical ramp body 220 and causing the tab 210 to translate closer to coupling member 218. Accordingly, the drive spring 284 may have any size and/or shape for compressing and extending. More, the drive spring 284 may be comprised of a variety of materials for compressing and extending, such as, but not limited to: metal, plastic, rubber, etc. and combinations thereof.

The illustrated second helical ramp body 222 is also coupled to a coupling member 218. The coupling member 218 provides coupling. As shown, the coupling member 218 includes teeth for providing coupling, however, the coupling member 218 may have a variety of configurations for providing coupling, such as, but not limited to: threading, serrations, teeth, knobs, protrusions, and texturing. Accordingly, the coupling member 218 may have any size and/or shape for coupling. Likewise, the coupling member 218 may be comprised of a variety of materials for coupling, such as, but not limited to: wood, metal, plastic, rubber, composite, PVC, etc. and any combination thereof.

Figure 13:
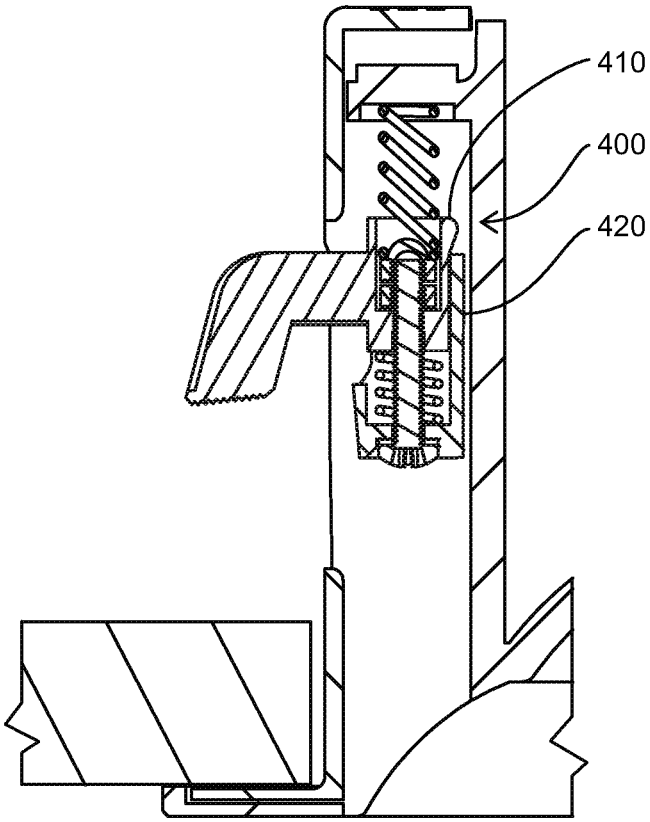
FIG. 13 is a side sectional view of a tab assembly of a mount in a first mode of engaging with a mount surface, according to one embodiment of the invention.
Figure 14:
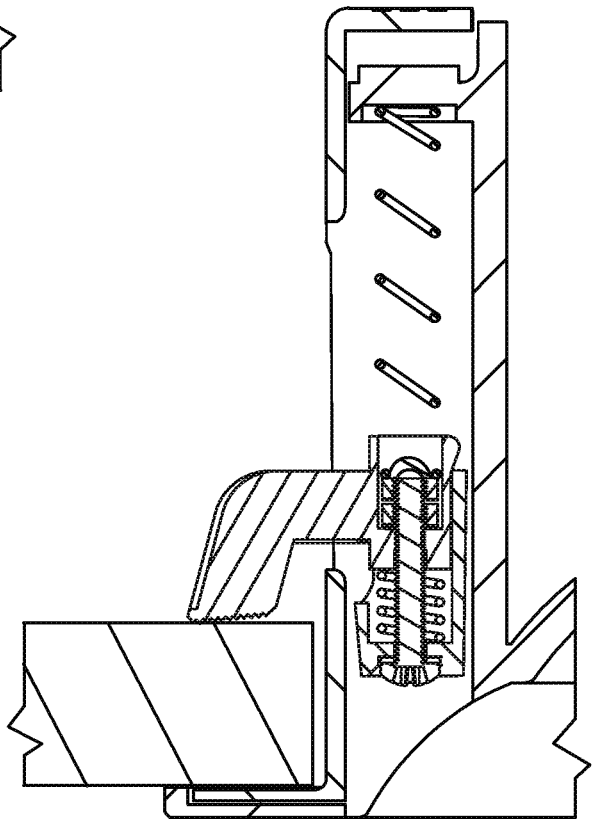
FIG. 14 is a side sectional view of a tab assembly of a mount in a second mode of engaging with a mount surface, according to one embodiment of the invention.
Figure 15:
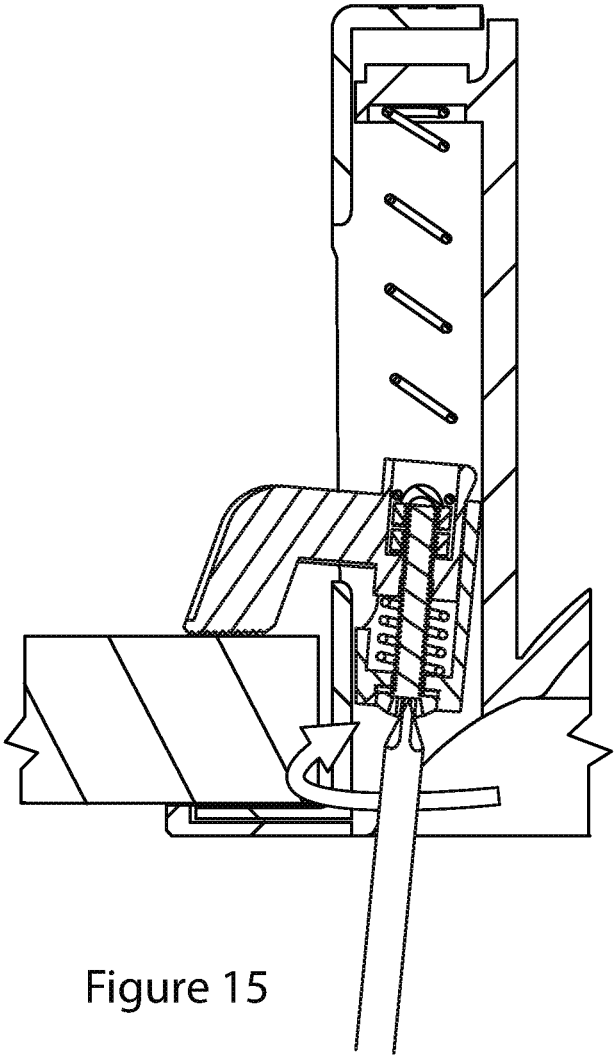
FIG. 15 is a side sectional view of a tab assembly of a mount in transition between a second mode of engaging with a mount surface and a third mode of engaging with a mount surface, according to one embodiment of the invention.
Figure 16:
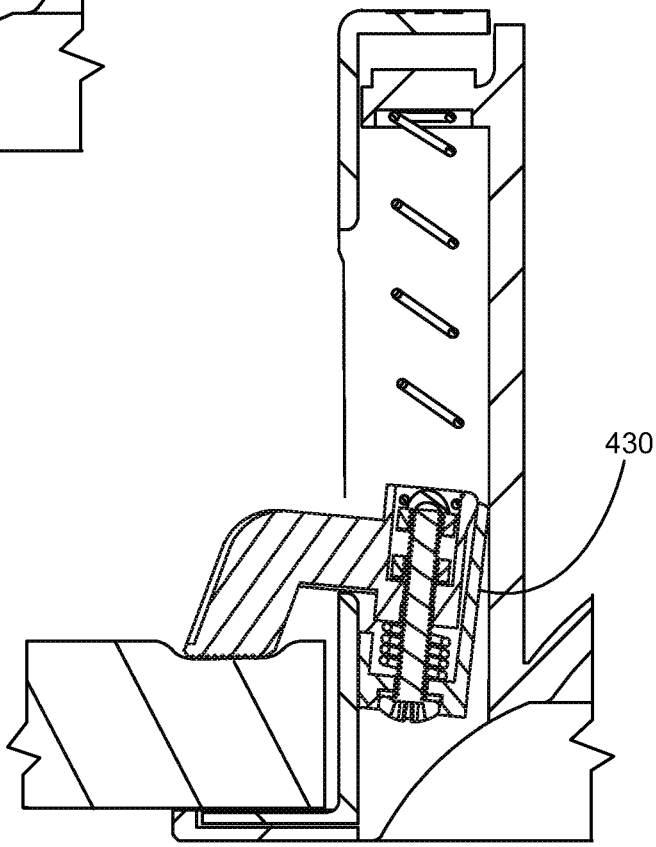
FIG. 16 is a side sectional view of a tab assembly of a mount in a third mode of engaging with a mount surface, according to one embodiment of the invention.

FIGS. 13-16 are side sectional views of a tab assembly of a mount utilizing an articulated wedge between the coupling member and the tab, according to one embodiment of the invention. FIG. 13 shows a first mode of engaging with a mount surface wherein the flange of the mount is adjacent to the mount surface (which may trigger a release of the tab assembly by operation of a trigger assembly not shown thereby causing it to spring down against the mount surface); FIG. 14 shows a second mode of engaging with a mount surface wherein the foot of the tab of the tab assembly is pressed against the mount surface; FIG. 15 shows transitioning between a second and third mode of engaging with a mount surface by actuation with a driver; and FIG. 16 shows a third mode of engaging with a mount surface wherein the tab assembly is locked into engagement with the mount surface. Accordingly, the tab assembly may be utilized to conveniently and easily secure a mount to a mount surface and easily lock the mount thereto in a manner that allows for later removal without damage to the mount surface. FIG. 11 is an exploded view of the tab assembly, thereof.

There is shown an articulating wedge 400 with a wedge 410. The wedge 410 is adjacent and slidably coupled to a sleeve 420. The wedge is fixedly coupled to the tab body such that as the tab body changes in spaced relation with the coupling member, the wedge goes deeper into the sleeve and thereby deforms 430 the sleeve to protrude outward (See FIG. 16) forming a wedge gap therebelow and thereby pressing the sleeve into the interior of the support member. This applies a force from the sleeve to the support member and helps to secure and lock the tab against the mounting surface.

The illustrated articulating wedge 400 includes a wedge 410. The wedge 410 is coupled to the sleeve 420 so that the wedge 410 may travel along the sleeve 420 and/or be wedged adjacent to the sleeve 420. For example, in one, non-limiting embodiment, the wedge 410 may be slidably coupled to the sleeve 420. The wedge 410 is substantially teardrop shaped; however, the wedge 410 may have any size and/or shape for forming a joint and/or wedging with the sleeve 420. As a result, the articulating wedge 400 may be comprised of a variety of materials, such as, but not limited to: wood, metal, plastic, rubber, composite, PVC, etc. and any combination thereof.

Figure 17:
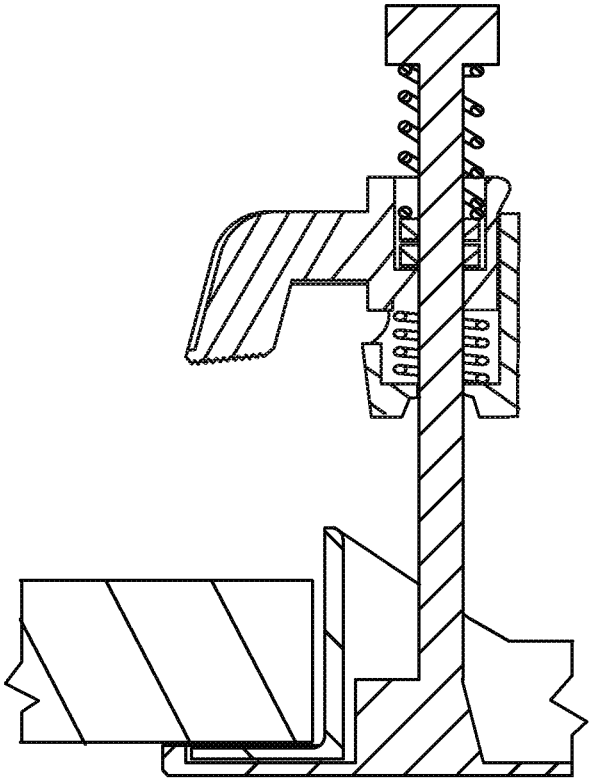
FIG. 17 is a side sectional view of a tab assembly of a mount wherein a coupling member and spacing mechanism collar a column-shaped support member, according to one embodiment of the invention.

FIG. 17 is a side sectional view of a tab assembly of a mount wherein a coupling member and spacing mechanism together form a collar about a column-shaped support member, according to one embodiment of the invention. While the other embodiments described herein illustrate tab assemblies having support members that are hollow and that contain the tab body and coupling member, FIG. 17 illustrates an assembly wherein the support member is a column that is encircled/collared by the tab body and coupling member, with the support member being the drive that actuates the spacing mechanism that effects a change in effective spacing between the coupling member and the tab.

Figure 18:
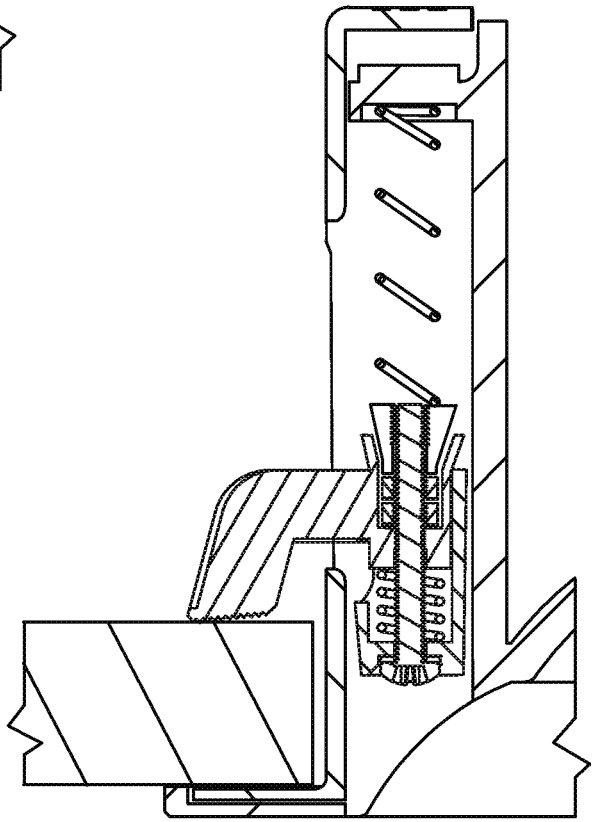
FIG. 18 is a side sectional view of a tab assembly of a mount wherein a spacing mechanism includes an articulating wedge threadedly coupled to a screw, according to one embodiment of the invention.

FIG. 18 is a side sectional view of a tab assembly of a mount wherein a spacing mechanism includes an articulating wedge threadedly coupled to a screw, according to one embodiment of the invention. There is shown an articulating wedge threadedly coupled at a terminal end of a screw and non-rotatably but slideably coupled to the illustrated tab body that deforms both the tab body and the coupling member simultaneously as the drive is actuated and the articulating wedge is pulled downward into the tab cavity. Following a pair of nuts that are similarly threadedly and non-rotatably coupled to the screw and tab body. As the tab body and coupling member are elastically deformed by the articulating wedge, force is applied against an interior of the support member which locks the tab against the illustrated mounting surface.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a speaker mount for mounting to sheet rock, it is understood that the speaker mount may be mounted to a variety of surfaces, such as, but not limited to: wood, plaster, brick, cement, etc. Additionally, although the figures illustrate a mount for a speaker, it is envisioned that the mount may be used for mounting a variety of objects, such as, but not limited to: speakers, lights, decorations, and so on.

It is expected that there could be numerous variations of the design of this invention.

Finally, it is envisioned that the components of the device may be constructed of a variety of materials, such as, but not limited to: wood, metal, plastic, rubber, composite, PVC, etc. and any combination thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A speaker mount, comprising:

a. a flange;

b. a support member coupled to the flange and having an elevated region spaced therefrom and a closer region closer to the flange than the elevated region, the closer region including a mating structure; and c. a tab assembly movably coupled to the support member, the tab assembly including:

i. a tab;

ii. a coupling member that couples to the mating structure of the support member; and iii. a spacing mechanism coupled to each of the tab and the coupling member that selectably changes an effective spacing between the tab and the coupling member such that the change in effective spacing results in a change in effective distance between the tab and the flange.

2. The mount of claim 1, further comprising a tab bias member functionally coupled to the tab assembly such that the tab assembly is biased towards the closer region.

3. The mount of claim 1, wherein the spacing mechanism includes a helical ramp rotatably coupled between the tab and the coupling member, wherein rotation of the helical ramp changes the effective spacing between the tab and the coupling member.

4. The mount of claim 1, wherein each of the coupling member mating structure includes mating teeth.

5. The mount of claim 1, wherein the spacing mechanism changes both an effective height of the tab assembly and an effective width of the tab assembly.

6. A mount assembly, comprising:

a. a flange;

b. a support member coupled to the flange and having an elevated region spaced therefrom and a closer region closer to the flange than the elevated region, the closer region including a mating structure;

c. a tab assembly movably coupled to the support member, the tab assembly including:

i. a tab;

ii. a coupling member that couples to the mating structure of the support member; and iii, a spacing mechanism coupled to each of the tab and the coupling member that selectably changes an effective spacing between the tab and the coupling member such that the tab and coupling member move relative to one another, and such that the change in effective spacing results in change in effective distance between the tab and the flange; and d. a tab bias member functionally coupled to the tab assembly such that the tab is biased towards the flange.

7. The mount assembly of claim 6, wherein the spacing mechanism includes a helical ramp rotatably coupled between the tab and the coupling member.

8. The mount assembly of claim 7, wherein each of the coupling member mating structure includes mating teeth.

* * * * *